United States Patent [19]

Yonker

[11] Patent Number: 4,513,764

[45] Date of Patent: Apr. 30, 1985

[54] VALVE

[75] Inventor: John H. Yonker, Carrollton, Tex.

[73] Assignee: Otis Engineering Corporation, Dallas, Tex.

[21] Appl. No.: 498,746

[22] Filed: May 27, 1983

[51] Int. Cl.[3] ..... E21B 43/12

[52] U.S. Cl. ..... 137/68 R; 137/115; 166/319

[58] Field of Search ..... 166/319; 137/461, 68 R, 137/117, 505.11, 115

[56] References Cited

U.S. PATENT DOCUMENTS

| | | | |
|---|---|---|---|
| 1,884,940 | 10/1932 | Whinnen | 137/505.11 |
| 3,005,507 | 10/1961 | Clark, Jr. et al. | 166/319 X |
| 3,331,378 | 7/1967 | Gibbs et al. | 137/68 R |
| 3,378,068 | 4/1968 | Page, Jr. | 166/319 X |
| 4,434,854 | 3/1984 | Vann et al. | 166/319 X |

*Primary Examiner*—Martin P. Schwadron
*Assistant Examiner*—Stephen M. Hepperle
*Attorney, Agent, or Firm*—M. H. Gay

[57] ABSTRACT

A valve which may be run in the open position, then in response to an increase in pressure in the flowway through the valve moved to closed position, and thereafter in response to a differential between pressure within and without the housing of the valve returned to open position.

8 Claims, 2 Drawing Figures

VALVE

Figure 1:
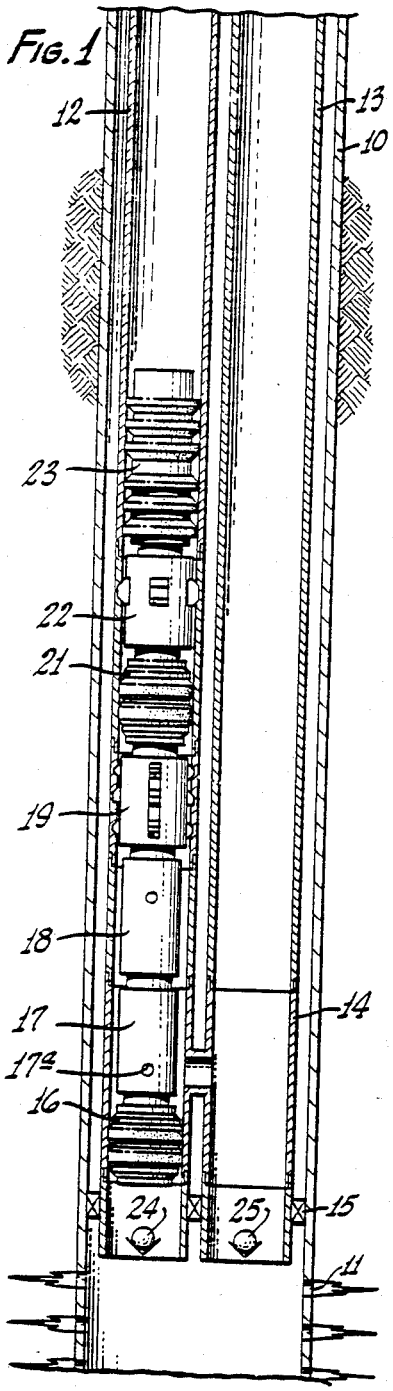

This invention relates to valves and more particularly to valves for controlling circulation in a well and for assisting in running equipment in the hole in TFL (through flow line) completions.

In TFL completions a circulation control valve is frequently desired to control circulation at the cross-over port, such as the crossleg of an H-member.

Further, in running equipment into the hole using TFL procedures, it is sometimes difficult to move fluids and to develop sufficient differential across the running piston to actuate the latch mechanism and latch the tool in place. For instance, in running a jet pump difficulty has been experienced in attempting to activate the latch mechanism to latch the pump in place because of the necessity of passing fluid through the small jet pump nozzle. The small nozzle will not permit fluid to pass at the rate desired to develop the needed differential across the pumpdown piston.

It is an object of this invention to provide a circulation control valve which may be run open, closed by pressure, and re-opened by pressure.

Another object is to provide a circulation control valve, as in the above object, in which the valve member is originally latched in the open position and is again latched in position when the valve is closed.

Another object is to provide a circulation control valve which employs first shear pins to latch the valve in its initial open position and second shear pins to hold the valve in closed position in which during shearing of the first pins the second pins are protected against shearing.

Another object is to provide a circulation control valve which may be run open, shifted to closed position solely by pressure acting directly upon the circulation control valve, and then re-opened again solely by pressure acting upon the circulation control valve.

Other objects, features and advantages will be apparent from the drawing, the specification and the claims.

Figure 2:
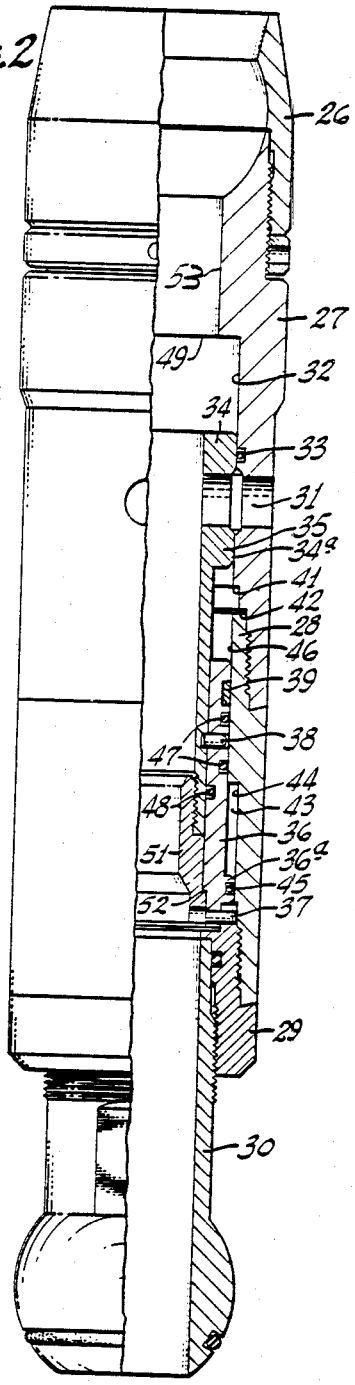

In the drawings wherein an illustrative embodiment of this invention is shown:

FIG. 1 is a schematic view of the lower portion of a well completed with an H-member and dual strings with a jet pump shown being latched in place with the TFL train including a circulation control valve in accordance with this invention; and FIG. 2 is a view partly in elevation and partly in quarter-section illustrating a circulation control valve constructed in accordance with this invention.

Referring first to FIG. 1, the lower portion of a well is shown with the casing 10 providing for production through perforations 11. The completion includes the two tubing strings 12 and 13 which terminate in the H-member 14, at the lower end of the string which is packed off with the casing by the packer 15.

A tool train is shown latched in tubing 12. The tool train includes the lower packer 16, the jet pump 17, the circulation control valve 18 of this invention, the locator mandrel 19, the upper packer 21, the lock mandrel 22, and the pumpdown piston 23.

The tool train would have been run using common TFL procedures to the position shown at which downward movement of the train is arrested by the locator mandrel 19. By developing a suitable differential across the pumpdown piston 23, the lock mandrel 22 is locked in place to retain the train in the position shown and the pumpdown piston is released from the lock mandrel. The circulation control valve 18 permits this differential to be developed. Thereafter, reverse circulation through the circulation control valve and up the tubing 12 will reverse out the pumpdown piston 23 leaving the remainder of the train in place.

The circulation control valve 18 is of the pressure controlled type, as will appear from a consideration of FIG. 2, and after the piston 23 is reversed out, the pressure within tubing 12 is increased to close the circulation control valve 18. Due to the two standing valves, indicated generally at 24 and 25 in the bottom of the tubings 12 and 13, pressure may be increased in both strings 12 and 13 by pressuring up one or both strings to close the circulation control valve 18. If only one string is pressurized, the other string may be shut-in at the surface as required to increase the pressure at the circulation control valve 18 to shut-in this valve. It is preferred to pressure both strings to protect O-ring 33 in the illustrated embodiment.

After the valve 18 has been closed, power fluid may be introduced into tubing string 13 and thence into the port 17*a* of pump 17 to operate the pump and produce the well through tubing 12.

When it is desired to pull the pump pressure will be increased in tubing 12 to a value relative to the pressure in tubing 13 such that the differential across the valve will open the valve. Thereafter, adequate circulation is provided between the two tubings 12 and 13 to run in a locomotive and withdraw the string.

The circulation control valve of FIG. 2 includes a housing provided by the swivel cap 26, the top sub 27, the central dome housing 28, the bottom sub 29, and the swivel ball 30. The valve is adapted to be connected by the swivel cap 26 and the swivel ball 30 in a power train in the conventional manner, such as shown in FIG. 1.

To provide for flow between the exterior and interior of the valve, the housing is provided with a side door port, such as port 31.

Flow through port 31 is controlled by a valve seat provided by the cylindrical surface 32 in the top sub 27 and the seal ring 33 carried in the cylindrical surface 32.

Cooperable with the valve seat is the valve member 34 provided by the upper end of the shear sleeve 35.

Valve actuator means is provided to move the valve member 34 from its run position shown in FIG. 2 to a position in which the port 31 is closed and thereafter to re-open the port 31 in response to control of pressure in the tubing strings 12 and 13.

The actuator for the valve 34 is provided by the shear sleeve 35 of which the valve 34 is a part, and the piston 36.

To maintain the valve 34 in its run position shown in FIG. 2, a first releasable latch means is provided by shear pin 37 which pins the piston 36 to the bottom sub 29 of the housing.

The piston and shear sleeve are connected by a second releasable latch means which includes the shear pin 38 and the latch ring 39.

Also forming a part of the second releasable latch means is the groove provided by the downwardly facing shoulder 41 in the top sub 27 and the opposing upper end 42 of the dome housing 28. The latch ring 39 is a conventional C-ring which when positioned over the groove provided by shoulders 41 and 42 springs outwardly into the groove a sufficient distance to latch the piston 36 to the housing.

In order that the piston 36 may move the valve to open position, a pressure dome is provided by the chamber 43.

The bore through the dome housing 28 is enlarged at 44 and the piston 36 has an enlargement 36*a* which cooperates with the enlarged bore portion 44. A sliding seal 45 between the dome housing and the enlarged piston portion 36*a* seals between the piston and housing.

The smaller diameter section 46 of the dome housing 28 is slidably engaged by piston 36 and a pair of sliding seals 47 seal between the piston and housing to complete the pressure dome 43.

Thus, after the valve has been run into the hole utilizing the port 31 to provide adequate circulation to permit proper operation of the pumpdown locomotive and to land the string in the hole, the valve may be closed by increasing pressure in the valve. As the valve is open this may be accomplished by pressuring up both strings 12 and 13 or one string may be closed and the other string pressurized. Preferably, both strings will be pressurized to provide within the bore through the valve a pressure substantially greater than the pressure within the dome 43. Dome 43 would normally be pressurized at atmospheric pressure reflecting the pressure conditions during assembly of the valve. Thus, by raising pressure within the valve to a selected value determined by the number and size of shear pins 37, the shear pins may be sheared and the piston 36 driven upwardly due to differential across the piston to move the valve 34 up to the closed position in which the surface 34*a* of the valve will be engaged by the seal 33 to close the valve port 31.

The piston is also provided with an internal seal 48 between the piston and shear sleeve 35 to prevent flow of fluid between the piston and sleeve.

Upon shearing of the shear pin 37, the piston 36 will be driven upwardly until the enlargement 36*a* of the piston 36 abuts the top of dome 43.

To avoid any possibility of premature release of the second releasable latch means, a stop nut 51 may be carried by the shear sleeve 35 and shoulder against the downwardly facing shoulder 52 within the piston so that the shear pin 38 is protected against premature shearing from the momentum of shear sleeve 35.

As the piston 36 is driven upwardly, the C-ring 39 will reach a position overlying the housing groove and will snap out into the groove provided between shoulders 41 and 42 and will latch the piston 36 in its full up position.

At this time the circulation control valve is closed and normal operations, such as production through the pump 17, may be carried out in the conventional manner.

When it is desired to re-open the valve, pressure within the bore 53 through the valve is increased to a selected value above the pressure outside of the valve controlled by the size and number of the shear pins 38 forming a part of the second releasable latch means. Thus, pressure is increased within the tubing string 12 relative to pressure within the tubing string 13 to provide across the shear sleeve 35 a selected differential effective on the pressure responsive surface defined by the valve seat seal 33 and the seal 48 between the piston and the shear sleeve. When the selected force is exerted by pressure on the so defined pressure responsive member, the shear pins 38 will shear and the shear sleeve 35 will be driven downwardly carrying the valve member 34 back to the position shown in FIG. 2 to re-open the valve port 31 to permit circulation through the circulation control valve to withdraw the string.

In operation the tool string illustrated in FIG. 1 is run into the hole with the valve member 34 in the position shown in FIG. 2. As the tool string reaches the position shown in FIG. 1, the locator mandrel 19 will locate the string in the hole and the lock mandrel 22 will be activated to lock the string in place and to release the pumpdown piston 23. Adequate circulation is provided for these operations when the string reaches a sealing relationship with the smooth bore provided in tubing 12 for landing the string by flow through the open port 31 of the circulation control valve 18.

After the string has been landed and the pumpdown locomotive 23 reversed out of the hole in the usual manner by circulating fluid through the port 31, the port 31 is closed.

In closing port 31 the pressure within the bore 53 is increased by increasing pressure within the tubings 12 and 13 to a value which will shear the first releasable latch means provided by shear pin 37 and drive the valve actuator upwardly until the C-ring 39 snaps out into the groove provided by shoulders 41 and 42, and latches the valve member in the up position with the piston 36*a* against the shoulder of the dome 43 with the surface 34*a* of the valve member engaging the seal 33 and closing port 31.

Thereafter, operations may be carried out in the conventional manner through the pump 17.

When it is desired to retrieve the string, pressure within the bore 53 of the valve is raised to a selected differential over the pressure outside of the valve, that is, in the tubing 13. This pressure acts upon the pressure responsive member provided by the shear sleeve 35, as defined by the seals 33 and 48 in a downward direction to shear the shear pins 38 of the second releasable latch means and release the shear sleeve 35 from the piston 36. When the pins 38 shear the shear sleeve and valve member are driven downwardly to the beginning position shown in FIG. 2 to reopen the port 31.

With the port 31 open for circulation between the tubings 12 and 13, a locomotive may be run into the tubing to engage and pull the tool string.

While the illustrated embodiment leaves the flowway open and controls a side door port it is obvious that the valve could be designed to control flow through the flowway for other installations.

This invention may be utilized in any situation where it is desired to put a plug in a blind hole. Note that no prong is needed; only pressure is manipulated.

The invention may also be used in any number of pumpdown or wireline operations such as chemical injection-two functions; kill valve; standing valve-pressure equalized; hydraulic pump-downhole; coil tubing-lift assist by TFL; and production test.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A valve comprising:

a housing having a flowway, a port connecting the flowway with the exterior of said housing, valve means controlling flow through said port, a low presure dome in said housing, first means responsive to an increase in pressure in said flowway to a selected value above the pressure in said dome for moving said valve means from port open to port closed position, and second means responsive to an increase in pressure within said flowway to a selected value above pressure exterior of said housing for returning said valve means to open position.

2. The valve of claim 1 wherein first releasable latch means is provided for initially latching said valve means in open position.

3. The valve of claim 1 or 2 wherein second releasable latch means is provided for latching said valve means in closed position.

4. A valve comprising:

a housing having a flowway, a port in said housing communicating the flowway with the exterior of the housing, a two-piece telescoping valve member controlling flow through said port, a low pressure dome in said housing provided in part by a first pressure responsive member carried by said valve member, first releasable latch means initially latching said valve member in port open position and released in response to a selected differential across said first pressure responsive member, second releasable latch means latching said valve member in port closing position upon release of said first latch means and movement of the valve means to port closing position by said first pressure responsive member, and a second pressure responsive member on said valve member exposed to pressure within said flowway on one side and pressure exterior of the housing on the other side with said valve member in closed position, said second releasable latch means including means releasably latching the two pieces of said valve member together and releasable in response to a selected differential across said second pressure responsive member to move said valve member to port opening position.

5. The valve of claim 4 wherein:

said first releasable latch means is shear pin means; and said second releasable latch means includes a latch member and cooperative groove carried by the housing and one of the pieces of the valve member; and shear pin means provides the means for latching the two-piece valve member together.

6. A valve comprising:

a housing having a flowway therethrough, an annular piston slidable in said flowway, spaced sliding seals of different diameter between said housing and said piston providing a sealed pressure dome and a pressure responsive member exposed to pressure within said flowway, first releasable latch means releasably retaining said piston in a first position with said dome at a selected relatively large volume, latch means between said housing and piston for latching said piston in said housing in a second position when said dome is reduced to a selected lesser volume by release of said first releasable latch means and movement of said piston by pressure acting on said pressure responsive member, a port in said housing, a shear sleeve carried by said piston and having a valve member permitting flow through said port when said first releasable latch means retains said piston in said first position, said shear sleeve having a pressure responsive member exposed to pressure within said flowway on one side and pressure exterior of the housing on the other side with said valve member preventing flow through said port, and second releasable latch means between said piston and shear sleeve released in response to a selected differential in pressure within said flowway and outside said housing moving said shear sleeve to port opening position.

7. The valve of claim 6 wherein said first and second releasable latch means include shear pins.

8. The valve of claim 7 wherein means are provided for preventing premature shearing of the shear pins of the second releasable latch means.

* * * * *